United States Patent [19]

Farque

[11] Patent Number: 4,894,135

[45] Date of Patent: Jan. 16, 1990

[54] ELECTROLYTE IR VOLTAGE COMPENSATOR FOR CATHODIC PROTECTION SYSTEMS OR THE LIKE

[76] Inventor: Anthony Farque, 6600 S. 223rd East St., Tulsa, Okla. 74014

[21] Appl. No.: 182,873

[22] Filed: Apr. 18, 1988

Related U.S. Application Data

[63] Continuation-in-part of Ser. No. 28,361, Mar. 20, 1987, abandoned.

[51] Int. Cl.[4] ..... C23F 13/02

[52] U.S. Cl. ..... 204/196; 204/197; 307/95

[58] Field of Search ..... 204/147, 196; 307/95

[56] References Cited

U.S. PATENT DOCUMENTS

| | | | |
|---|---|---|---|
| 4,080,272 | 3/1978 | Ferry | 204/196 |
| 4,160,171 | 7/1979 | Merrick | 307/95 |
| 4,255,242 | 3/1981 | Freeman | 204/196 |
| 4,383,900 | 5/1983 | Garrett | 204/196 |
| 4,664,764 | 5/1987 | Zofan | 204/196 |

*Primary Examiner*—John F. Niebling
*Assistant Examiner*—Ben C. Hsing
*Attorney, Agent, or Firm*—Robert R. Keegan

[57] ABSTRACT

There is disclosed a cathodic protection system current control apparatus incorporating an IR compensator circuit wherein the electric potential between a reference cell such as a copper-sulfate half-cell and the wall of a tank or other structure being corrosion protected is measured in such a way that nearly all of the potential due to IR voltage drop through the electrolyte is compensated for and eliminated leaving only a voltage measurement representing the true electrolytic potential at the cathodically protected object. This true electrolytic potential is utilized to act as a control input for a conventional current controller to maintain the desired electrolytic potential by changing the current passing through the electrolyte. The compensator circuit includes a rectifier device and a capacitor charged by a constant current source, and thus has a much longer response time for rising voltage values than it does for falling voltage values. This substantially eliminates the effect of IR voltage drop in the electrolyte which rises and falls 120 times per second. A preferred circuit includes an operational amplifier having a semi-conductor diode connecting with the output and then to a junction of conductors from a constant current source and a capacitor connected to ground; feedback from the diode to an amplifier input eliminates the effect of diode forward voltage drop.

17 Claims, 6 Drawing Sheets

$$e_{222} = e_1 + \frac{V_{D24}}{A_{VOL.}} = e_1 + \frac{0.7V}{100,000} = e_1 + 7\mu V \cong e_1$$

ELECTROLYTE IR VOLTAGE COMPENSATOR FOR CATHODIC PROTECTION SYSTEMS OR THE LIKE

This application is a continuation-in-part of my copending application Ser. No. 028,361 for Electrolyte IR Compensator Circuit for Cathodic Protection Systems or the like, filed Mar. 20, 1987, now abandoned.

The present invention relates to electric current and electric potential control systems for cathodic protection systems and particularly to electronic circuits for accurate control of electrical potential in such systems by compensating for unpredictable IR voltage drops in the electrolytic fluid to which the apparatus being protected is exposed.

Impressed current cathodic protection systems are well known and are commonly used to prevent a metallic object or apparatus in contact with an electrolytic fluid from corrosion induced by electrolytic action. In such systems a current is made to flow between an anode constituting part of the system and the metal object or structure being protected. This current is in the opposite direction to the current that would be produced by electrolytically induced corrosion.

One electrical potential in the current loop through the electrolyte is represented by the operative anticorrosion potential while another potential or voltage drop is due to the current flow through the effective resistance of the elecrtrolyte volume. These two potentials will be referred to as the electrolytic potential and the IR potential respectively. Any convenient measurement made of voltage or currents in the circuit tend to identify only the sum of the two potentials and it is a persistent problem in this field to independently measure the electrolytic potential which one wishes to set and maintain at some desired level.

None of the various techniques for measuring the electrolytic potential or what is sometimes called the IR drop free potential of a cathodically protected object or apparatus has satisfied all requirements of efficient, economy, simplicity and reliability. It is common practice to place a reference cell in the system as shown for example in U.S. Patent to Garrett No. 4,383,900 issued May 17, 1983, and U.S. Patent to Freeman No. 4,255,242 issued Mar. 10, 1981. By measurement of a reference cell electrode potential or current an endeavor is made to isolate the electrolytic potential or the true cathode polarization potential which one seeks to maintain at a desired level. Such use of a reference cell does not solve the problem because errors are introduced by the IR drop conponent induced by current flowing between the cathode and anode of the protection system on a reference cell which is used to measure voltages or currents in the system.

Control circuits for cathodic protection systems have made use of the fact that voltages (or currents) applied to the cathodic protection loop may be pulsating or varying voltages rather than constant voltages and it is thus possible to make measurements under different voltage conditions to aid in isolating and controlling the electrolytic potential apart from the IR potential. For example, the above reference patent to Garrett describes means to force the voltage and current delivered to a structure being cathodically protected to zero. In Garrett the reference cell potential is measured during this zero sampling time and by comparison with this potential a controlled output to achieve the desired level of cathodic protection is said to be obtained.

In the Garrett apparatus and other prior devices, notwithstanding their quite complicated electronic systems the desired advantages achieved by simple compensation for IR voltage drop in a cathodic protection system are not obtained. Other time sequence sampling approaches are shown in U.S. Pat. No. 4,160,171 to Merrick issued July 3, 1979, and U.S. Pat. No. 4,080,272 to Ferry et al. issued Mar. 21, 1978.

The present invention provides a relatively simple improved circuit for providing the desired IR compensation and thus accurate control in a cathodic protection system which exploits the rectified sine wave characteristic of conventional voltage supplies and provides a circuit with a nonreciprocal temporal response characteristic that effectively diminishes by 99 percent or better any error caused by IR voltage drop being added to an electrolytic potential which is sought to be measured.

In addition to providing above described features and advantages it is an object of the present invention to provide a simple improved control circuit to maintain the desired cathodic protection electrolytic potential level in the face of variations in IR drop through the electrolyte due to temperature changes, composition changes, or other factors.

It is another object of the present invention to provide a simple and effective improved control circuit for cathodic protection systems to maintain the desired cathodic protection level without the necessity for generating and applying sampling pulses in the electrolyte current loop to compute the necessary compensation for IR voltage drop in the electrolyte.

Other objects and advantages of the invention will be apparent from consideration of the following description in conjunction with the appended drawings in which.

Figure 1:
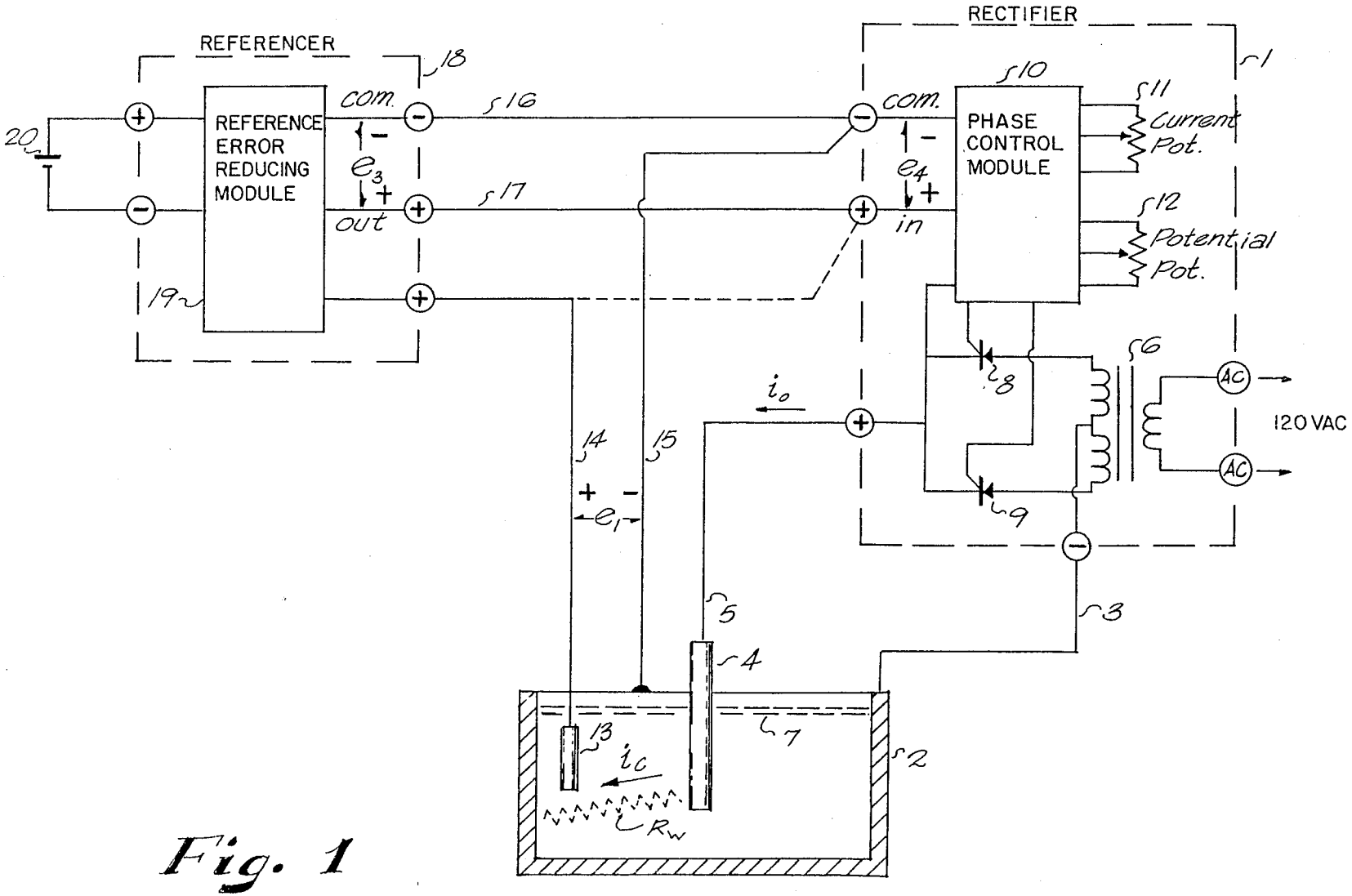
FIG. 1 is a block diagram of the impressed current rectifier and IR compensation circuits as applied to a tank for water or other fluid.

Referring to the drawings and particularly FIG. 1, a conventional rectifier and phase shift controller 1 is shown in a typical water tank cathodic protection application. The negative output terminal of controller 1 is connected to the tank 2, usually steel, through a conductor 3 and the positive output terminal of controller 1 is connected to an anode 4 through a conductor 5. Power is supplied by an AC input (typically 120 V) to transformer 6 which isolates the input power from the tank 2 and also provides adjustable current and voltage to the effective resistance of the electrolyte (water) 7 between anode 4 and the tank 2. A portion of the electrolyte resistance $R_w$ is shown schematically through which a current $i_c$ is made to flow when SCRs 8 and 9 are turned on by a phase control module 10. A potentiometer 11 provides for the adjustment of the output current $i_o$ allowed to flow before the conduction of SCRs 8 and 9 is reduced. A potentiometer 12 provides for the adjustment of the potential $e_4$ about which the phase control module 10 will regulate the conduction of SCRs 8 and 9.

Copper-sulfate reference half-cell 13 is of the type commonly used in corrosion prevention, and it is suspended by a watertight conductor 14 in electrolyte 7 and spaced from the wall of tank 2. Signal $e_1$ is the electrochemical potential $E_p$ which arises between a copper-sulfate half-cell 13 and the steel wall of the tank 2 and may typically be about 450 mV when $i_o$ is zero. When $i_o$ is not zero then a current $i_c$ representing some portion of $i_o$ that flows along path $R_w$ results in a voltage $e_R$ which adds to $E_p$ causing an error and now $$e_1 = E_p + i_c R_w$$

or $$e_1 = E_p + e_R.$$

Figure 4:
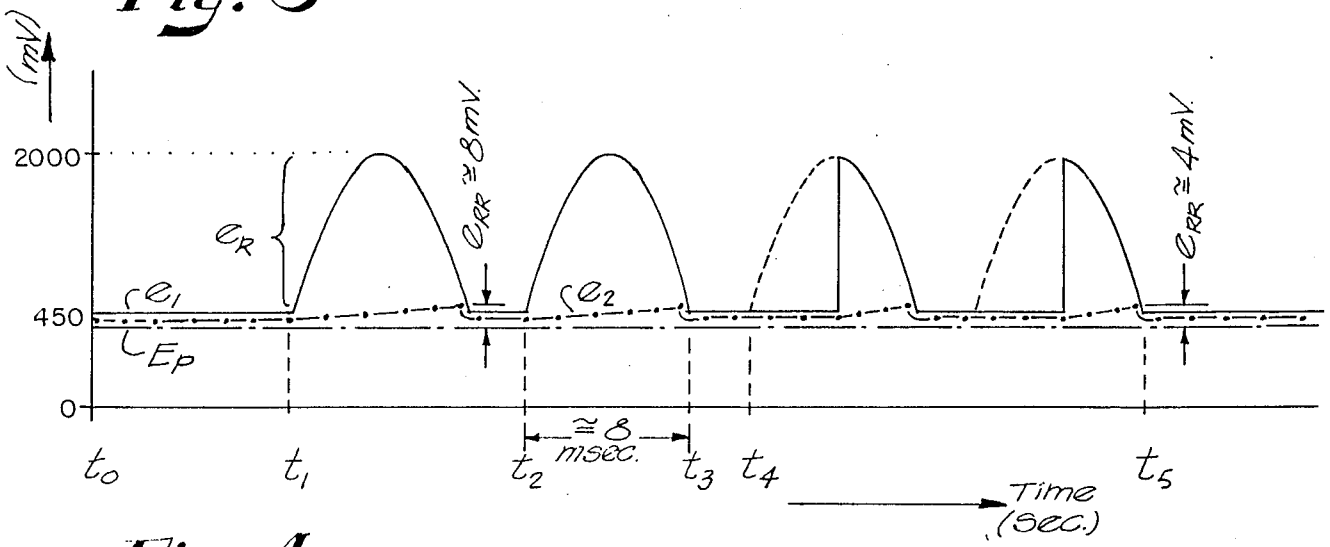
FIG. 4 is a graph of the input and output wave forms for typical cathodic full-wave rectified sinusoidial inputs.
Figure 7:
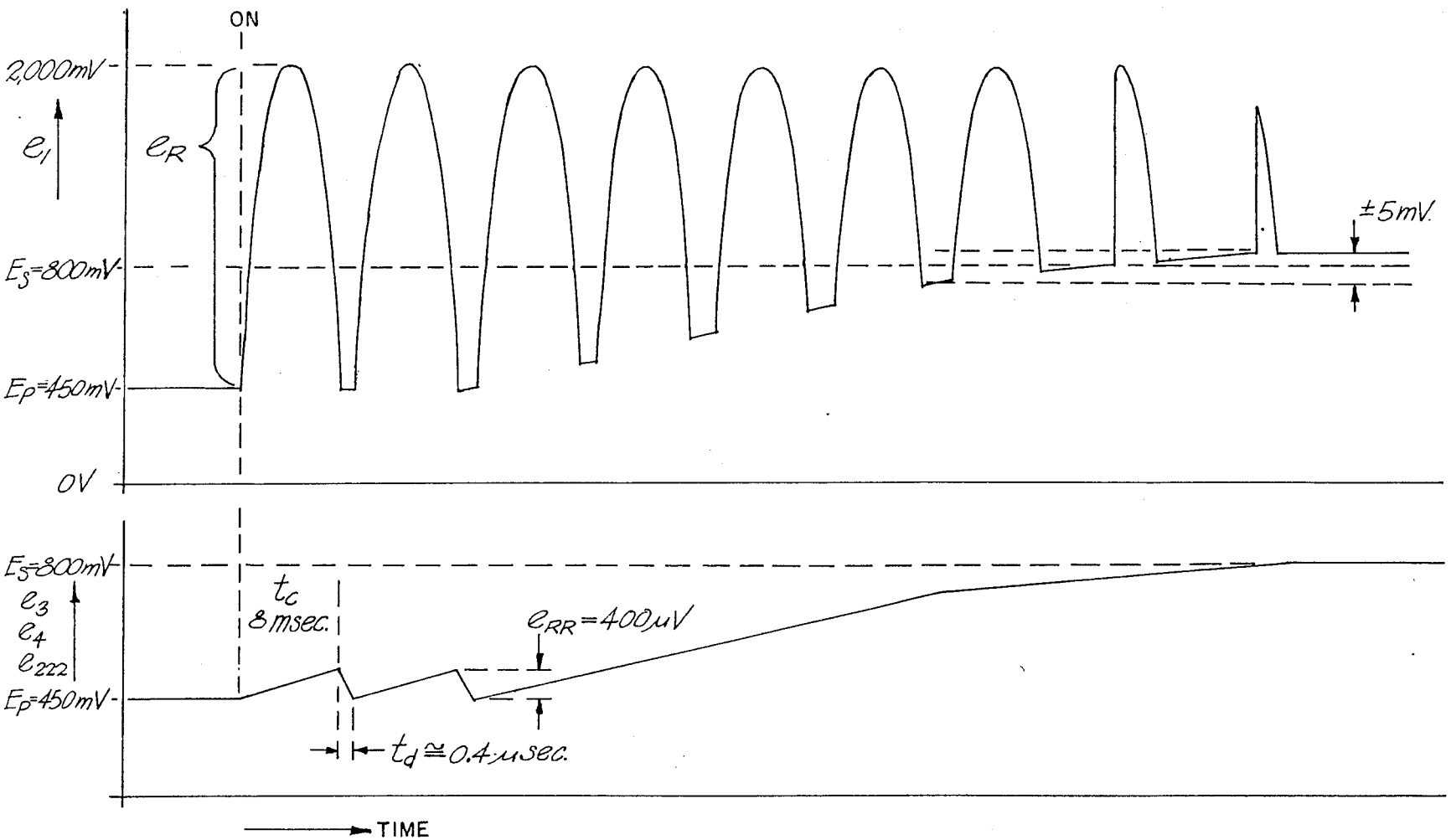
FIG. 7 is a graph of electrical wave forms present in a circuit according to the invention useful in describing the operation thereof.

These voltages are shown in FIGS. 4 and 7. In FIG. 1 $e_1$ could be conveyed directly to the input of the phase module 10 according to prior known techniques, and lead 14 would take the dotted route. In that case, leads 16 and 17 would not be used nor would referencer 18. Such a circuit configuration would result in sensitive and stable operation. The $e_R$ component would, however, cause errors in the phase control module's sensing of $E_p$ by more than 100 percent for some tank installations.

According to the present invention with $e_1$ conveyed to the input of referencer 18 through leads 14, 15, and 16 the reference error reducing module 19 can remove most of the $e_R$ component from $e_1$ and output voltage $e_3$, conveyed by lead 17, which is essentially $E_p$ as can be seen in FIG. 4 and FIG. 7.

Operation of error reducing module 19 is independent of phase control module 10 internal circuitry and timing. No sync or sampling pulses are necessary for module 19 to operate. Battery 20 (or other DC power supply) supplies power to module 19. Battery 20 could be replaced by a small AC to DC converter but no use is made of the frequency or phase of the power line in module 19. While the referencer 18 is shown as separate from the rectifier and controller 1 for clarity, it could easily be built into a conventional phase control module 10 since its operation is completely automatic and requires no additional inputs or adjustments.

Figure 2:
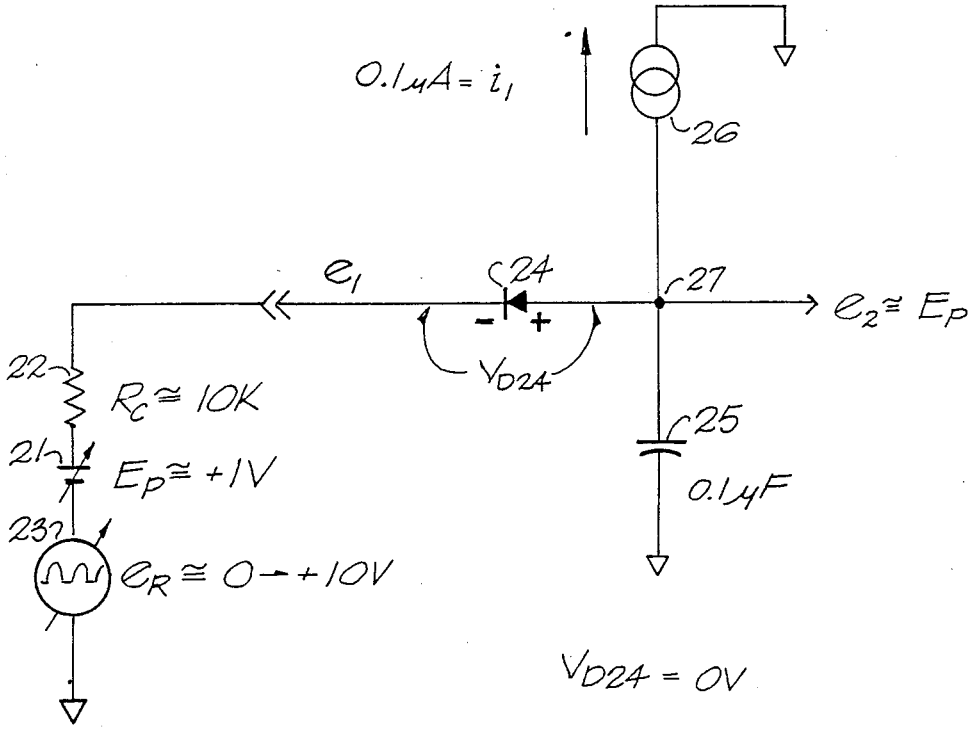
FIG. 2 is an electrical schematic of the invention using an ideal diode.

To aid in explaining the invention FIG. 2 shows an equivalent circuit for generating the wave forms and internal resistance of a reference cell immersed in an electrolyte and subject to an error voltage. An adjustable DC voltage source 21 produces $E_p$, a potential from 450 to 1000 mV which is equivalent to the electrochemical cell potential. A fixed resistor 22 of approximately 10K is equivalent to the internal resistance $R_c$ of the cell. A positive voltage source 23 having the capability to generate an arbitrary wave form of adjustable amplitude from 0 to about +10 volts is equivalent to the error voltage $e_R$ arising from a current flow in the electrolyte. Voltage $e_1$ is approximately the sum of sources 21 and 23 if the current flow in resistor 22 is neglected. Two further simplifying assumptions will be made in the explanation of the operation of this circuit. The first is that diode 24 is ideal and thus has no voltage drop or internal resistance. The second is that no current is drawn by any instrument or circuitry that might be connected to node 27 to sense voltage $e_2$. Current $i_1$ of 0.1 microamp magnitude is caused to flow uninterruptedly into node 27 by current source 26.

Figure 3:
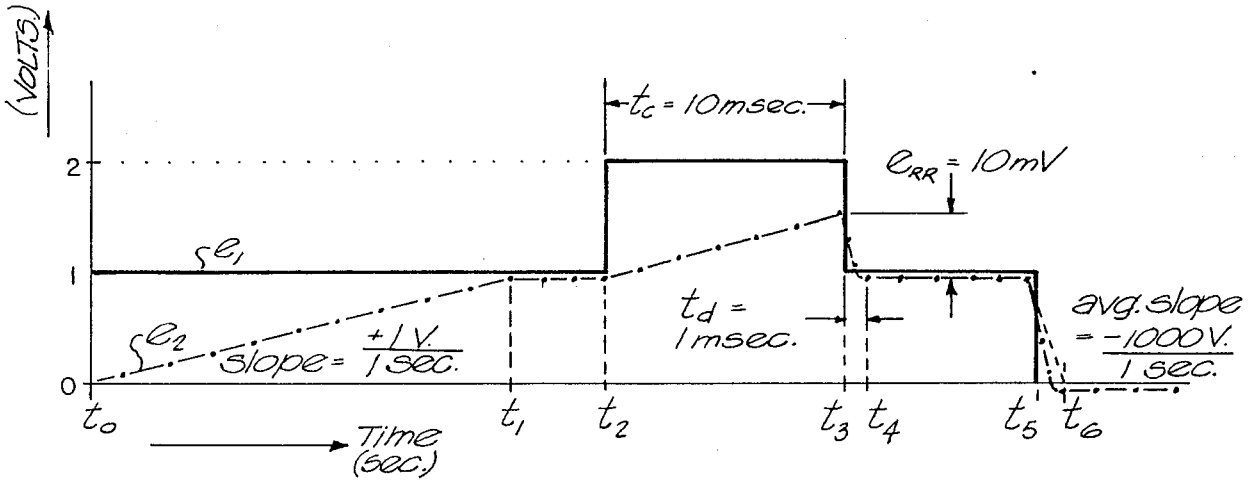
FIG. 3 is a graph of the input and output wave forms showing the requisite disparity in the response times for positive and negative going transitions.

There are two alternate paths for current flow out of node 27. One is through diode 24, resistance 22, sources 21 and 23. The other is to capacitor 25. With diode 24 ideal these two paths are mutually exclusive; that is the current $i_1$ flows either entirely in one or the other depending on the relation of $e_1$ and the charge of capacitor 25. There is no condition for which a portion of $i_1$ flows in one path and the remainder flows in the other. Refer now to FIG. 3 in which the voltages $e_1$ and $e_2$ are plotted vs time with some exaggerations of scale. With initial conditions at $t_0$ of $E_p = e_1 = 1$ V, $e_R = 0$, capacitor 25 is discharged and thus $e_2 = 0$. Diode 24 has a reverse bias of 1 V across its terminals and consequently conducts no current. Current $i_1$ flows into capacitor 25 and the accumulated charge results in a linear increase in the potential across its terminals which is voltage $e_2$. The slope of this linearly increasing $e_2$ is determined by the magnitudes of current $i_1$ and capacitor 25. For the magnitudes of current $i_1$ and capacitor 25 in FIG. 2, this slope is 1 v/1 sec. Note that the magnitude of the potential $e_1$ has no influence on this slope.

As the magnitude of potential $e_2$ increases toward the magnitude of potential $e_1$, there is a time $t_1$ where $e_1 = e_2$. At this instant diode 24 commences to conduct current $i_1$ to voltage source $E_p$. The initial 1 V across the terminals of voltage source $E_p$ is unchanged by this conduction of current $i_1$. For clarity in FIG. 3, the potentials $e_1$ and $e_2$ are shown slightly displaced vertically from one another in three places where $e_1 = e_2$. Diode 24 serves to limit potential $e_2$ to equal $e_1$ provided sufficient time is available. Between $t_1$ and $t_2$ this limiting the responsible for maintaining $e_2 = e_1$. At time $t_2$ a step change in the magnitude of source $E_p$ to +2V occurs. This resulting change in $e_1$ is shown lasting for time $t_c = 10$ msec during which time capacitor 25 is charged by current $i_1$. The slope is the same as before and in 10 msec the voltage $e_2$ moves by $e_{RR} = 10$ mV. Notice that $e_2$ does not reach $e_1$ and diode 24 never conducts during the interval from $t_2$ to $t_3$. At $t_3$ a step change in the magnitude of source $E_p$ to +1 V occurs. As the magnitude of $e_1$ decreases below the magnitude of $e_2$ diode 24 conducts current $i_1$ as previously described and it also conducts a second current which discharges capacitor 25 exponentially through the resistance 22 until $e_1 = e_2$ again at $t_4$. The interval between $t_3$ and $t_4$, called the discharge time, $t_d$, has an RC time constant of about 1 msec. Between $t_4$ and $t_5$ diode 24 again limits $e_2 = e_1$. At time $t_5$ a step in the magnitude of source $E_p$ to 0 occurs. This resulting change in $e_1$ is shown as is the exponential change in $e_2$ as capacitor 25 is discharged through resistor 22 by conduction via diode 24. From $t_6$ on $e_1 = e_2$ and current $i_1$ flows in diode 24. Again the discharge time $t_d$ is about 1 msec. The significance in the comparisons of these two discharge currents is that for the same 1 msec. interval the first discharged a +10 mV potential and the second discharged a +1 V potential, the average slope of $e_2$ between times $t_5$ to $t_6$ with a 1 V negative going step in $e_1$ is −1,000 V/1 sec. This is a factor of 1,000 greater than the +1 V/1 sec. slope of $e_2$ for a 1 V position going step in $e_1$. This asymmetry in the rates with which $e_2$ may follow changes in $e_1$ results in a circuit which stores the lowest positive potential of signal $e_1$ on capacitor 25 while being essentially nonresponsive to the higher positive potentials of signal $e_1$. This contrasts with conventional rectifier circuits with a diode and capacitor which store the highest positive potential in a wave form and are much less responsive to the lower positive potentials therein.

Figure 5:
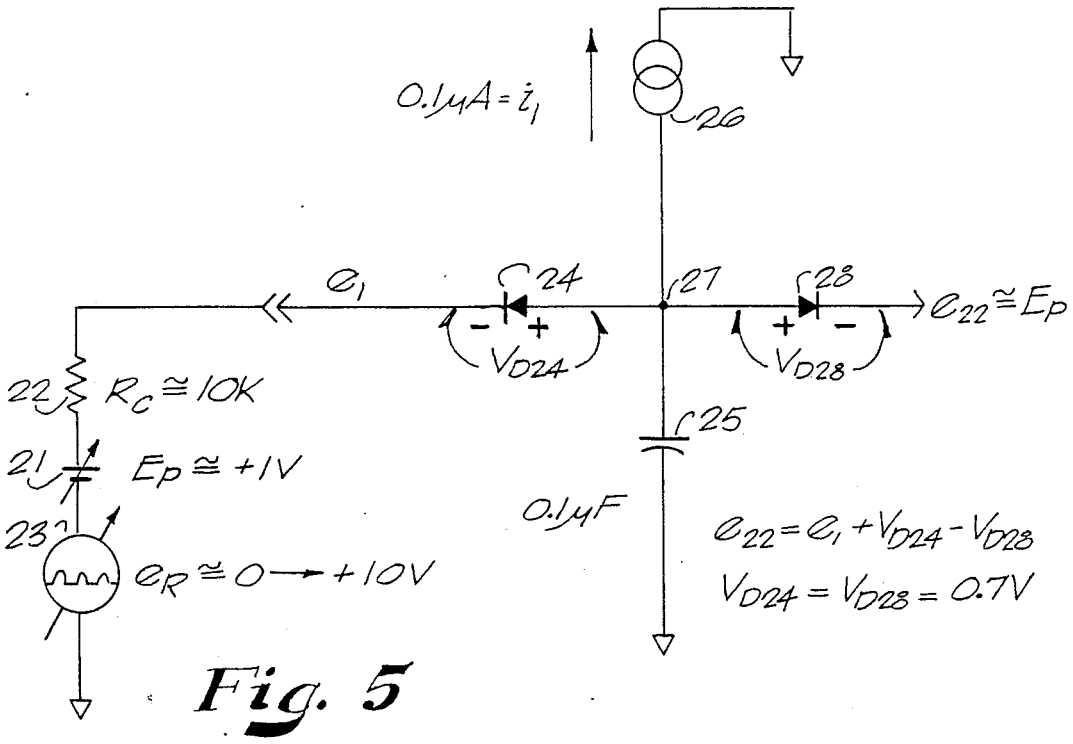
FIG. 5 is an electrical schematic of an embodiment of the invention using matched real diodes.

Depicted in FIG. 4 are wave forms that are typical of a rectifier as installed and operating as shown in FIG. 1. Within the referencer 18 is an ideal diode circuit equivalent of FIG. 2. Potential $E_p$ is shown to be 450 mV throughout the time for which FIG. 4 applies. In the interval from $t_0$ to $t_1$ potentials $e_1$ and $e_2$ are both equal to $E_p$. For clarity again these wave forms are shown slightly displaced vertically where they are equal. During the interval $t_1$ to $t_3$ full-wave rectified sinusoidal current $i_0$ flows for two 180° intervals with SCRs 8 and 9 each triggered once. The flow of current $i_c$ in water resistance $R_w$ produces the error potential $e_R$ which is added to the potential $E_p$. The magnitude of $e_R$ may range from tens of millivolts to tens of volts. For an accurate measurement of potential $E_p$ this potential $e_R$ must be removed. During the 8 msec time that potential $e_1$ is more positive than potential $e_2$ current $i_1$ flows into capacitor 25 and potential $e_2$ moves upward at the 1 v/1 sec. rate. The maximum ramp obtained on potential $e_2$ is 8 mV during the 8 msec half cycle period of the 60 Hz power line. This 8 mV potential on capacitor 25 is discharged rapidly as potential $e_1$ returns to the 450 mV level of potential $E_p$. As may be seen graphically, the error potential $e_R$ has been removed from potential $e_1$ and the ramp potential $e_{RR}$ has been generated in its stead. The worst case error contributed by this ramp potential of 8 mV atop the actual potential $E_p$ of 450 mV is 1.8%. Clearly this is a greater improvement over the more than 100% error contributed by the worst case potential $e_R$ of several volts atop potential $E_p$. In the interval between $t_4$ and $t_5$, two 90° conductions by SCRs 8 and 9 show the potential $e_{RR}$ to be 4 mV. As the conduction angles for the SCRs are reduced, so, too, are the ramp potentials $e_{RR}$. The magnitudes of capacitor 25 and current $i_1$ may be selected to reduce the slope of potential $e_2$ to limit the worst case error potential $e_{RR}$ to an arbitrarily small voltage. In FIG. 2 the hypothesis of an ideal diode for diode 24 does simplify the discussion of the operation of the circuit, but a practical circuit must use real diodes. Small silicon diodes have a forward voltage drop of 0.7 V and resistances of a few hundred ohms. Only the forward drop voltage is of consequence herein. One simple circuit in which the forward drops of two matched real diodes are subtracted to yield near ideal diode characteristics is shown in FIG. 5. Real silicon diodes 24 and 28 having 0.7 V drops are both in series between potentials $e_1$ and $e_{22}$ and connected so that their voltages $V_{D24}$ and $V_{D28}$ are of opposite polarities and hence cancel. Practical implementation of the invention is possible with this subtraction technique and the resulting wave forms from the circuit in FIG. 5 will be essentially the same as for the ideal diode implementation of FIG. 2.

Figure 6:
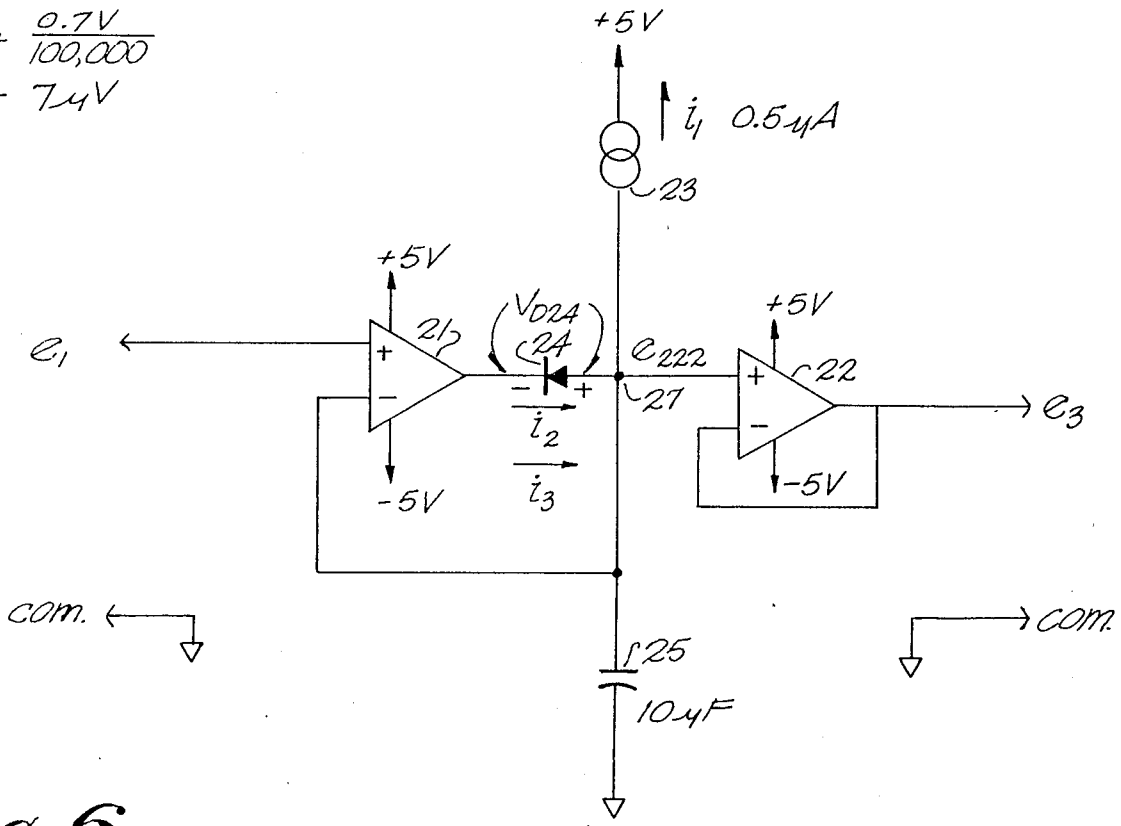
FIG. 6 is an electrical schematic of an embodiment of the invention using a real diode and an operational amplifier.

Another simple circuit in which the forward drop of a real diode is reduced by division to yield near ideal diode characteristics is shown in FIG. 6. Operational amplifier (opamp) circuit techniques are used to reduce the 0.7 V drop $V_{D24}$ of a real silicon diode 24. This reduction is accomplished by using the high open loop voltage gain, $A_{VOL}$, of opamp 21 to divide $V_{D24}$ by such a high number that the remaining voltage is made inconsequentially small. A worst case magnitude of $A_{VOL}$ for common opamps is 100,000. This results in an apparent diode voltage drop of 7 microvolt. Such a small voltage is indeed insignificant and the operation of the circuit is essentially that of the ideal circuit of FIG. 2. Note that opamp 21 is bidirectional even though current may flow in only one direction through diode 24. With a unidirectional opamp the rectification provided by diode 24 would be inherent as would be the division or offset of rectifier back voltage. A second opamp 22 serves only as a unity voltage gain buffer to provide $e_3$ which is equal to $e_{222}$ and which may be connected to buffer the effect of meters, resistors, or other devices in the event that they draw appreciable currents. Practical implementation of the invention is possible with this division technique and the resulting wave forms from the circuit in FIG. 6 will be essentially the same as for the ideal diode circuit implementation of FIG. 2. Opamps 21 and 22 are low input current types with voltage outputs. A current source 23 for $i_1$, now chosen to be 0.5 microamps, may be a current regulator diode, a discrete synthesized circuit, or in some cases a high value resistor. Capacitor 25 is typically of 10 microfarad value. These magnitudes for $i_1$ and capacitor 25 constrain the maximum ramp obtained on potential $e_{222}$ to be 400 microvolts during the 8 msec. half cycle interval. Current $i_1$ flowing into node 27 may flow through diode 24 into the output of opamp 21 and this is the origin of current $i_2$. For those conditions where potential $e_1$ is equal to potential $e_{222}$, diode 24 limits any further increase of potential $e_{222}$. Where potential $e_1$ is less positive than potential $e_{222}$, current $i_2$ continues to flow as above and current $i_3$ also flows as capacitor 25 is discharged. (Current arrows indicate electron flow.) Where potential $e_1$ is more positive than potential $e_{222}$, both currents $i_2$ and $i_3$ are zero and current $i_1$ charges capacitor 25. Current $i_3$ for typical opamps is on the order of 10 milliamps. Capacitor 25 may be seen to be discharged by a current which is 20,000 times larger than the current which charges it. As a consequence potential $e_{222}$ is able to follow decreasing changes in the input potential $e_1$ 20,000 times faster than for increasing inputs. It is this assymmetry in response times which enables this circuit to separate the desired slow changing $E_p$ from the fast changing $e_R$.

Assymetric temporal response is employed in electronic circuits for other purposes as may be seen in *Engineers Notebook*, 1980 Edition, by Forrest M. Mims, III, Publ. by Radio Shack, 1979, Page 102. Variations of such circuits could be adapted to provide such function in the apparatus of FIG. 6 or FIG. 8, or the present circuits could advantageously be used for such other purposes.

Referring to FIG. 7 $e_i$, prior to ON, no $i_o$ circuit flows from the anode 4 to tank 2 and $e_1$ has the value of $E_p$=450 mV and no error component $e_R$ is present. Under these initial conditions $e_1=e_{222}=e_3=450$ mV which is a true and accurate value of $E_p$. After ON, the current $i_o$ is allowed to flow and the error component $i_cR_w$ now produces the voltage $e_R$ which could have a value of several volts, typically 2,000 mV, depending upon the location of cell 13 with respect to the anode 4 and tank 2. The magnitude of current $i_c$ and the effective resistance of the water (electrolyte) $R_w$, both of which are greatly variable with time and water conditions, also influence the magnitude of $e_R$. Potential $E_s$ is that which is deemed to provide the desired protection against corrosion and is selected by adjustment of the potential control pot 12. The 850 mV value is representative of a set point $E_s$ on a steel tank 2 employing a copper-sulfate half-cell 13. As current $i_o$ flows into the tank 2, $E_p$ increases slowly over a period of days to weeks, until it approaches the set point $E_s$ and the phase control module 10 retards the conduction of SCRs 8 and 9 which reduces the current $i_o$ to just maintain $E_p$ approximately equal to $E_s$.

The proportional control band over which the phase control module 10 exercises full to zero conduction of SCRs 8 and 9 is approximately ±5 mV. That is for a set point $E_s$ of 800 mV the SCRs will be operating at half conduction when $E_p$ is also at 800 mV. For an increase of $E_p$ to 805 mV conduction will be zero, and for a decrease of $E_p$ to 795 mV conduction will be maximum. As may be appreciated, such precise control over $E_p$ is not possible if the error component $e_R$ of several volts is not removed from $E_p$ before being utilized by the phase control module 10.

The output voltage $e_3$ of the referencer 18 is conveyed to phase control module 10 via lead 17 and $e_3=e_4$ for all conditions and is substantially free of $e_R$ components. The ramp error voltage $e_{RR}$ that accumulates during the time $t_c$ that $e_R$ exceeds $E_p$ is governed by $i_1$, capacitor 25, and the time of charge $t_c$, but is in no way related to the magnitude of $e_R$ or $E_p$. The worst case for $e_{RR}$ for a 60 Hz full-wave rectified application with the circuit of FIG. 2 is the 400 microvolts for an 8 msec. half-cycle previously discussed, which for an 800 mV set point contributes only a 0.05 percent error. FIG. 3 is not to scale, and for clarity the first two half-cycles of $e_{RR}$ are shown greatly exaggerated.

The explanation of the theory of operation of the various components of the circuit disclosed herein is believed to be correct, but the novelty and effectiveness of the circuit is not based on the theory of operation presented but is rather based on actual performance of apparatus incorporating circuits according to the invention.

Figure 8:
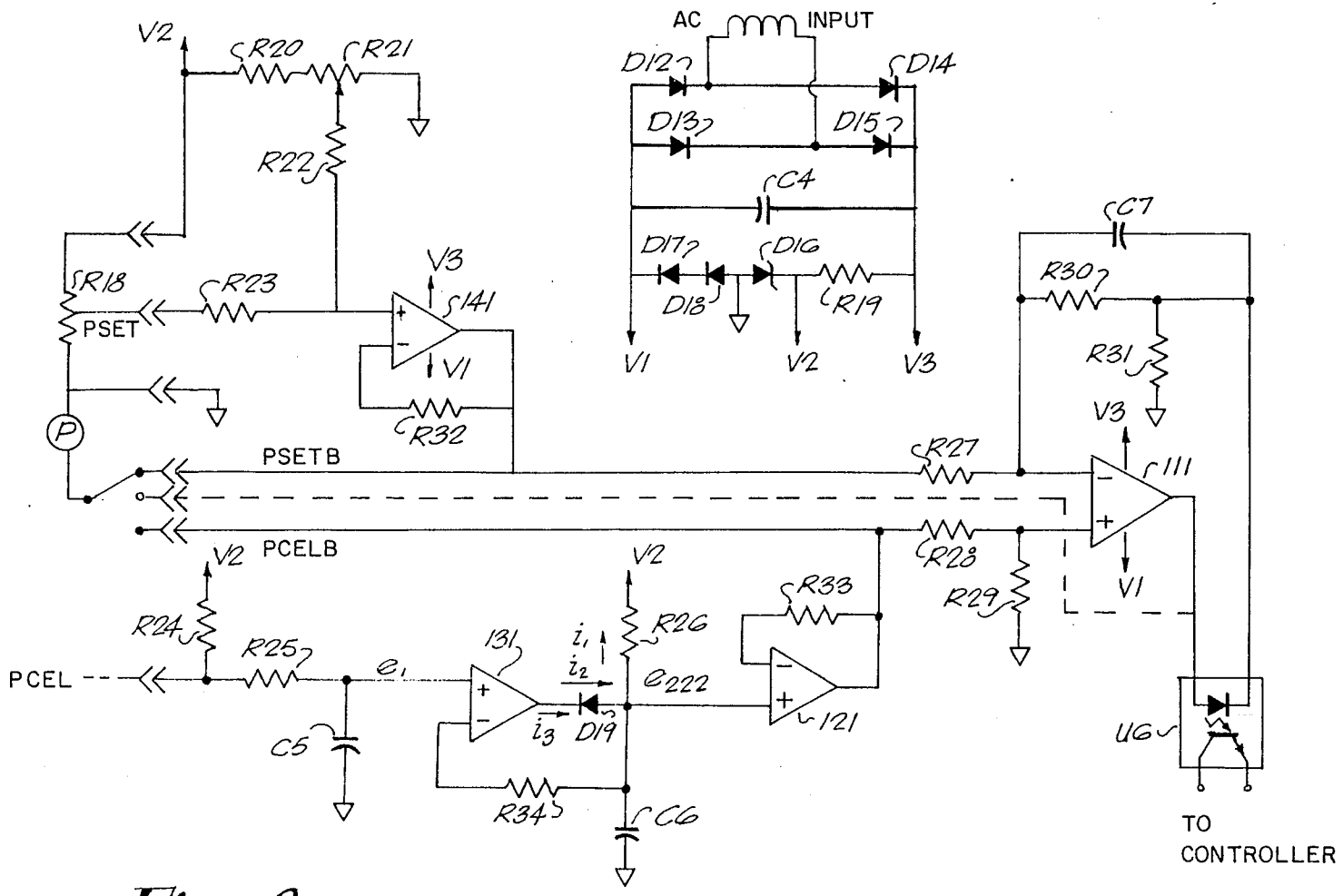
FIG. 8 is an electrical circuit schematic of a practical circuit embodying the present invention.

Referring now to FIG. 8 a practical compensator circuit or referencer is shown corresponding generally to the simplified schematic diagram of FIG. 6.

Opamp 141 and associated components R18, R20, R21, R22 and R32 are connected as a noninverting buffer, and its function is to follow the voltage input from the wiper of external pot R18. This pot is connected across +6.2 V and ground. When external pot R18 is used, the internal pot R21 is rotated fully CCW and the circuit operates as though R20 and R21 are removed from the circuit. Resistors R32, R33, and R34 are current limiting resistors and appear as shorts or negligible resistance in normal operation.

Opamp 131 and associated components R25, R26, R34, C6, and D19 perform an IR compensating function previously explained with reference to FIG. 6. Components R24, R25, C5, R34, and R33 are either current limiting or have other non-compensating function and may be deleted if desired. Opamp 111 and associated components R27, R28, R29, and R30 are connected as a differential amp with a voltage gain of 1000 for each input.

Optical coupler U6 and associated components R30, R31, and C7 are used to transfer the output of amp 111 across an isolation barrier between controller 1 and module 19.

Components C7, R31, and U6 may be deleted with the output of amp 111 connected to rightmost terminal of R30 to eliminate the optical coupling.

The operator adjusts pot R18 to set the potential around which he wants the controller 1 to operate. This is PSET which is buffered by amp 141 with a voltage gain of 1 to establish a buffered set point potential PSETB. For all normal conditions PSET=PSETB and low impedance potential meter P may be connected through a switch to read PSETB at the output of opamp 141 accurately whereas if it were connnected to PSET directly it would cause a loading error. In practice the operator may observe such a meter while he adjusts pot R18 to the desired set point. To determine the actual cell potential (PCELB) with the IR component removed the operator may connect a meter through a switch to the output of opamp 121 which is a buffered output. Opamp 121 operates as buffer with a voltage gain of 1 and a high input impedance to drive a meter.

The output of opamp 111 may be connected to a meter through a switch. If the operator now connects a meter to opamp 111 he will observe the difference between PSETB and PCELB multiplied by the voltage gain of 1000. That is:

METER READING=1000 (PCELB-PSETB).

A millivolt difference between the input voltages yields a one volt output with a positive swing indicating that PCELB is the larger and a negative swing indicating that PSETB is larger. And when P=0 volts they are equal: and in a controller application this would indicate to the operator that the cell potential had increased or decreased until it equaled the set point.

Representative values for the components of FIG. 8 are shown in Table 1 below.

TABLE 1

| DESIGNATOR | P/N | VALUE | MFR |
|---|---|---|---|
| C4 | NLW | 100 μF25 V | CDE |
| C6, C7 | | 10 μF | Pana |
| C5 | | 0.01 μF | Thomson |
| D12 thru D15 | IN4003 | 200 V 1 A | Moto |
| D16 | IN821A | 6.2 V | Moto |
| D17, D18, D19 | IN4148 | 75 V | TI |
| R19 | | 750 10% ¼ W. | Mepco |
| R31 | | 1K 10% ¼ W. | Mepco |
| R25, R32, R33 | | 10K 10% ¼ W. | Mepco |
| R34 | | | |
| R26, R29, R30 | | 10 M 1% ¼ W. | Mepco |
| R20, R27, R28 | | 10K 1% ¼ W. | Mepco |
| R22, R23 | | 100K 1% ¼ W. | Mepco |
| R24 | | 100 M 1% ¼ W. | Hy-Meg |
| R18, R21 | | 10K trimmer | Spectrol |
| 111, 121, 131, | CA | | |
| 141 | 3240AE | CMOS opamp | RCA |
| U6 | TIL-111 | Opt. Coup. | TI |

From the foregoing description it will be seen that an IR compensator circuit for cathodic protection systems is provided which is relatively simple and easy to incorporate with conventional phase shift current control apparatus for such systems. It exploits the pulsating characteristic of rectified alternating current applied to the anode and protected structure in such systems and causes the reference cell potential supplied to the current controller to be compensated 99 percent or better to eliminate the effect of IR voltage drop due to current passing through the electrolyte. The use of the compensator circuit according to the invention minimizes the amount of monitoring of the system which is required and causes the system to automatically accommodate to changing conditions and maintain the true electrolytic potential substantially constant.

In addition to those variations and modifications to the apparatus according to the invention which have been described, shown, or suggested above, other variations and modifications will be apparent to those of skill in the art and accordingly the scope of the invention is not to be considered limited to those variations or embodiments suggested or described herein, but it is rather to be determined by reference to the appended claims.

What is claimed is:

1. In an impressed current cathodic protection system having a controller for rectified AC impressed current passing through an electrolyte with an input for receiving a signal from a reference cell, an IR compensator circuit comprising a first operational amplifier adapted to receive a signal from a reference cell, a rectifier diode connected from the output of said amplifier to a node point having a measurable voltage thereat, a feedback connected from said node point for said amplifier, a substantially constant current source connected to said node point, a capacitor connected between said node point and a ground potential point, and means for supplying said voltage at said node point as the reference cell signal to said controller input.

2. Apparatus as recited in claim 1 further including means for producing an adjustable constant voltage and means for subtracting said constant voltage from the voltage at said node point before supplying it to said controller input.

3. Apparatus as recited in claim 1 wherein said means for supplying the voltage at said node point to said controller input comprises a second operational amplifier.

4. Apparatus as recited in claim 1 wherein said rectifier diode is connected between said capacitor and the output of said first operational amplifier with a polarity to cause current thereof to discharge said capacitor.

5. Apparatus as recited in claim 1 wherein said controller includes a pair of thyristor elements which are phase shift controlled to provide rectified AC current of controllable average value through said electrolyte.

6. In a cathodic protection system having a controller for rectified AC impressed current with an input for receiving a reference signal, an IR compensator circuit comprising a rectifying device adapted to receive a reference cell signal and provide a current path to a node point having a measurable voltage thereat, means for eliminating the effect of forward voltage drop in said rectifying device, a current source connected to said node point, a capacitor connected to said node point in parallel with said rectifying device, and means for supplying the voltage of said node point as the reference signal to said controller input, thereby causing said circuit to have separately determined positive going and negative going signal response rates for said reference cell signal which differ by a factor of at least 100.

7. A circuit as recited in claim 6 further including means for producing an adjustable constant voltage and means for subtracting said constant voltage from the voltage at said node point before supplying it to said controller input.

8. A circuit as recited in claim 6 wherein said means for eliminating the effect of forward voltage drop comprises an operational amplifier connected to receive feedback from said rectifying device.

9. A circuit as recited in claim 8 wherein said rectifying device is connected between said capacitor and the output of said operational amplifier.

10. A circuit as recited in claim 6 wherein the current from said current source charges said capacitor at less than 10 volts per second.

11. An impressed current cathodic protection system comprising a controller for rectified AC impressed current passing through an electrolyte with an input for receiving a signal from a reference cell, a reference cell, a first operational amplifier connected to said cell, a second operational amplifier connected to receive an input from the output of said first operational amplifier, means for causing said second operational amplifier, to have separately determined positive going and negative going signal response rates which differ by a factor of at least 1000, and means for supplying the output of said second operational amplifier as the reference cell signal to said controller input.

12. A system as recited in claim 11 further including means for producing an adjustable constant voltage and means for subtracting said constant voltage from the output of said second operational amplifier before supplying it to said controller input.

13. A system as recited in claim 11 wherein said means for causing includes a rectifier diode connected at one end to receive the output of said first operational amplifier.

14. A system as recited in claim 11 wherein said means for causing includes a capacitor, a rectifier diode connected between said capacitor and the output of said first operational amplifier, and a current source connected to charge said capacitor.

15. A system as recited in claim 14 whrein said rectifier diode is connected between said capacitor and the output of said first operational amplifier with a polarity to cause current thereof to discharge said capacitor.

16. A system as recited in claim 14 wherein the current from said current source charges said capacitor at less than 10 volts per second.

17. A system as recited in claim 11 wherein said controller includes a pair of thyristor elements which are phase shift controlled to provide rectified AC current of controllable average value through said electrolyte.

* * * * *